US005429475A

United States Patent [19]

Mohr

[11] Patent Number: 5,429,475

[45] Date of Patent: Jul. 4, 1995

[54] JOGGER FOR STRAIGHTENING SHEETS IN TIERS

[76] Inventor: Wolfgang Mohr, Hundshager Weg 42, D-65719 Hofheim, Germany

[21] Appl. No.: 207,844

[22] Filed: Mar. 8, 1994

[30] Foreign Application Priority Data

Mar. 9, 1993 [DE] Germany ..... 43 07 361.1

[51] Int. Cl.[6] ..... B65H 31/00

[52] U.S. Cl. ..... 414/788; 414/907; 271/210; 271/211; 271/213; 271/221

[58] Field of Search ..... 271/210, 211, 213, 220, 271/221; 414/788, 907

[56] References Cited

U.S. PATENT DOCUMENTS

| | | | |
|---|---|---|---|
| 1,107,859 | 8/1914 | Stevens | 271/211 |
| 3,724,089 | 4/1973 | Thompson et al. | 414/788 |
| 4,132,400 | 1/1979 | Naramore | 271/211 |
| 4,178,119 | 12/1979 | Busch | 414/788 |
| 5,197,849 | 3/1993 | Tubke | 414/788 |

FOREIGN PATENT DOCUMENTS

| | | | |
|---|---|---|---|
| 1461237 | 12/1968 | Germany | 271/211 |

*Primary Examiner*—H. Grant Skaggs

*Attorney, Agent, or Firm*—Max Fogiel

[57] ABSTRACT

A jogger for straightening material in tiers. The material rests against at least two lateral baffles associated with adjacent sides of a stack-supporting surface. The stack-supporting surface can vibrate. A gantry travels back and forth in the same plane as the stack-supporting surface. The stack-supporting surface can be tilted out of the horizontal toward the two lateral baffles. A top-covering plate (21) is mounted in the gantry (16) and parallels the stack-supporting surface (3). The stack (40) is accommodated between the top-covering plate and the stack-supporting surface. Mechanisms (22) accommodated in the gantry lower the top-covering plate onto and raise it off the stack-supporting surface. Blowers (30 & 31) for forcing wind between the tiers are accommodated in at least one (25) of the lateral baffles (25, 26, & 27). At least one side-covering plate (33 or 34) closes off the space between the stack-supporting surface and the top-covering plate. The side-covering plate can be positioned at a right angle to the first lateral baffle by mechanisms for moving the covering plate toward and away from the parallel second lateral baffle. The stack is accordingly enclosed all around with the exception of an outlet for the wind.

21 Claims, 4 Drawing Sheets

JOGGER FOR STRAIGHTENING SHEETS IN TIERS

BACKGROUND OF THE INVENTION

The present invention concerns a jogger for straightening material in tiers. The material rests against at least two lateral baffles associated with adjacent sides of a stack-supporting surface. The stack-supporting surface can vibrate. A gantry travels back and forth in the same plane as the stack-supporting surface. The stack-supporting surface can be tilted out of the horizontal toward the two lateral baffles.

The purpose of tilting a jogger's stack-supporting surface toward is to align the edges of any sheets resting on the surface against the lateral baffles. To eliminate friction between the sheets, the stack is winded before being jogged. The winding occurs in a separate device. To prevent the sheets from shifting after being jogged, the stack is compacted by a press bar and the wind is expressed by a mechanism that strokes over the top of the stack away from the press bar to the other side. The stack emerges from this procedure in the form of a dense block that can be forwarded to a downstream trimmer for example. The stack is usually jogged by vibrating the tilted stack-supporting surface. The wind is usually expressed by a roller that lowers onto the stack and rolls over it.

A jogger of the aforesaid type is known form German GM 9 004 711. Since the stack being jogged is secured on the stack-supporting surface only by the two lateral baffles, the surface can be tilted only to a limited extent. It accordingly takes longer to jog the separate tiers against the lateral baffles and straighten up the stack. The procedure takes even longer when the sheets in the stack are relatively rough-surfaced. The squeegee rollers ascend and descend pneumatically on the traveling gantry. The jogger lacks an integrated winder.

A stack reverser is known from the brochure Herold-Stapelwende, published by Maschinenfabrik H. Herold, Bonn, Federal Republic of Germany. The stack is straightened by jogging. A continuous top-covering plate parallels the stack-supporting surface and rises and lowers on it. Blowers mounted on opposite sides of the device force wind in between the tiers.

SUMMARY OF THE INVENTION

The object of the present invention is an improved jogger of the aforesaid type that will rapidly straighten the stack and precisely align the edges of the sheets without consuming too much power and extensively independently of the properties of the material being jogged.

This object is attained in accordance with the invention in the generic jogger by

- a top-covering plate mounted in the gantry and paralleling the stack-supporting surface, whereby the stack is accommodated between the top-covering plate and the stack-supporting surface,
- mechanisms accommodated in the gantry and lowering the top-covering plate onto and raising it off the stack-supporting surface,
- blowers for forcing wind between the tiers and accommodated in at least one of the lateral baffles,
- at least one side-covering plate for closing off the space between the stack-supporting surface and the top-covering plate, whereby the side-covering plate can be positioned at a right angle to the first lateral baffle by mechanisms for moving the covering plate toward and away from the parallel second lateral baffle.

It is essential to the jogger in accordance with the invention for at least one side of the stack, preferably the side the wind emerges from, to be completely covered. This feature will promote rapid jogging with a minimum of wind and accordingly consuming little energy. The bottom of the stack is accordingly covered by the stack-supporting surface and the top of the stack by the top-covering plate. The term covering indicates that the stack is entirely or extensively covered in the vicinity of the plate to prevent leakage or ensure minimal or acceptable leakage of wind. The stack is also enclosed along three of its four sides, specifically at least by the two or more lateral buffers positioned at a right angle to each other and by the side-covering plate that forms a U in conjunction with them. The wind enters between the two lateral baffles, the side-covering plate, the top-covering plate, and the stack-supporting surface essentially through the blowers associated with the first lateral baffle in this embodiment and travels through the sheets that constitute the stack, exiting from the uncovered side opposite the first lateral baffle. Additional blowers can of course be integrated into the second lateral baffle and even into one or more of the covering plates.

The top-covering plate in another embodiment of the invention is in several parts that slide together and apart in a specific direction. The multiple-part covering plate makes it possible in conjunction with the one or more and preferably two side-covering plates at a right angle to the first lateral baffle to vary the size of the space, which constitutes a wind chamber in accordance with the size of the sheets. The wind will accordingly enter the stack at an ideal distance from the components that enclose it and from the blowers accommodated in the components. The side-covering plates are preferably secured in the top-covering plate perpendicular to it and accordingly perpendicular to the stack-supporting surface as well. The jogger in accordance with the invention accordingly makes it possible to ideally handle stacks of different height.

The top-covering plate can in particular be rectangular and tripartite. One component can be a T-shaped base mounted in the gantry. Its other two components can slide together and apart, into the remainder of the rectangular cross-section, in the base. This design will ensure that the top-covering plate covers the stack with no significant gap even when the other two components are positioned together on top of the T-shaped base. The other two components are preferably actuated in a practical procedure by two pneumatic cylinders mounted on the top of the base with piston rods engaging the other components. The two side-covering plates are preferably positioned on the apart-facing sides of the other two components, each mounted in the other component. The side of the top-covering plate facing away from the first lateral baffle can also accommodate several and especially two holddowns for holding down the stack.

Another embodiment of the jogger features a third lateral baffle that forms the shape of a U in conjunction with the first and second lateral baffle. The third lateral baffle makes it possible to jog at two corners of the jogger. The two side-covering plates are also provided for this purpose, although either only the second or only the third lateral baffle participates along with whatever side-covering plate is associated with the unemployed baffle. Blowers for forcing wind between the tiers can be integrated into the second and/or the third lateral baffle as well as into the first.

The blowers integrated into the first lateral baffle in one embodiment of the invention have stationary stabilizing nozzles and, perpendicular to the surface of the first lateral baffle, moving fanning nozzles, with stabilizing nozzles at the ends of the first lateral baffle. The blowers in the second and third lateral baffles need only stationary stabilizing nozzles.

The stack can be particularly effectively winded over its total width before being jogged when stabilizing nozzles associated with a specific lateral baffle are accommodated with the fanning nozzles between them essentially at the ends of the baffle. The external stabilizing nozzles accordingly constantly replace from outside the wind escaping from between the sheets, while the internal traveling fanning nozzles wind, in accordance with their position, only specific tiers of the stack. The area of the outlet of each stabilizing nozzle can to advantage be adjusted to the properties of the sheets being jogged. The top and bottom of the outlet can be adjusted or closed off in accordance with the height of the stack. Depending on the dimensions of the sheets and on the direction of jogging, accordingly, the supply of wind to the external stabilizing nozzles can be completely discontinued with the stack resting against the first and second lateral baffles or against the first and third lateral baffles. The fanning nozzles should have a slide with outlets of limited height. It is practical for the width of the outlets alone to be individually adjusted to the properties of the material being jogged. It is of advantage for the slide to travel back and forth to ensure that the outlets will emit wind only at the momentary height of the stack.

The top-covering plate and especially its base can have additional blowers for generating a cushion of wind between it and the top of the stack. The top-covering plate and especially its base can have auxiliary jogging baffles that can be aimed toward the first lateral baffle in the area of the stack-supporting surface facing away from that baffle. After brief winding and jogging, the auxiliary jogging baffles can be lowered in front of the stack and slowly and gently advanced along the stack to the desired sheet size. Any sheets still projecting will simultaneously be inserted into the winded stack.

The jogger can also have a mechanized holder that can reach through a breach in the first lateral baffle and clamp down on one tier of the stack. The breach can be provided with a seal to prevent or extensively inhibit wind from leaking through it when the holder is disengaged.

The top-covering plate employed in the present invention accordingly demarcates the surface of the stack facing away from the stack-supporting surface. It allows the surface to tilt farther out of the horizontal, 90° for example, than it could without a top-covering plate. Also essential is for the top-covering plate to operate in conjunction with the blowers. The stationary stabilizing nozzles wind the full width of the stack, and the wind escaping at the unenclosed side of the stack is constantly replaced. The top-covering plate is opened, raised perpendicular to the stack-supporting surface, that is, in accordance with how high the separate tiers float. The stabilizing nozzles simultaneously prevent the stack from S-curving. The traveling fanning nozzles also travel up and down the stack, winding whatever section they cover. The nozzles can be adjusted to sheets of a wide range of materials. Winding is reinforced by jogging the stack on the stack-supporting surface. The fanning nozzles gently lift the winded section from the associated baffle. Once the fanning nozzles have passed, the just winded section of the stack will settle back subject to its own weight against its associated baffle.

As hereintofore indicated, the top-covering plate must not force individual tiers against the stack-supporting surface while the stack is being winded, which would prevent the tiers from floating. A probe aimed between the stack-supporting surface and the top-covering plate and traveling perpendicular to the surface of that plate will accordingly be of advantage for establishing the top-covering plate in a particular ideal position. The probe will constantly detect the level of the stack and adjust the top-covering plate accordingly.

A belt with fanning brushes can be mounted on the same side of the top-covering plate as the blowers in the jogger in accordance with the invention. The belt can be constantly advanced with the brushes facing the stack traveling up. The result will be even more ideal fanning, allowing the blowers to inject wind more effectively between the individual tiers.

The structure and position of the top-covering plate is of particular significance to the jogger in accordance with the invention. Mounting it in the gantry makes it possible to advance it out from above the stack-supporting surface so that the surface can accept a stack unimpeded. The multiple parts that comprise the top-covering plate make it possible to adjust it to tiers of different sheet size, with the blowers always at a prescribed distance from the stack that is independent of the size of the sheets. As hereintofore indicated, the basic structure of the jogger in accordance with the invention ensures that a stack that is to be winded and jogged is completely enclosed except for an area for the wind to escape out of. A parallelepipedal stack will accordingly be closed off on five of its six sides. It is basically conceivable to close off the sixth side as well if the component that closes it off has an outlet for the wind. A third side-covering plate with at least one wind outlet can for example be positioned parallel to and away from the first lateral baffle and travel back and forth laterally and perpendicularly thereto. The wind inside the space occupied by the stack can be rendered more directional if the side is closed off by a funnel with a vacuum at its outlet instead of by the third side-covering plate.

Further characteristics of the present invention will be evident from the subsidiary claims, the specification, and the figures. All individual characteristics and all combinations thereof are essential to the invention.

One embodiment of the invention will now be specified by way of example without in any way limiting its scope with reference to the drawing, wherein

DESCRIPTION OF THE PREFERRED EMBODIMENTS

Figure 1:
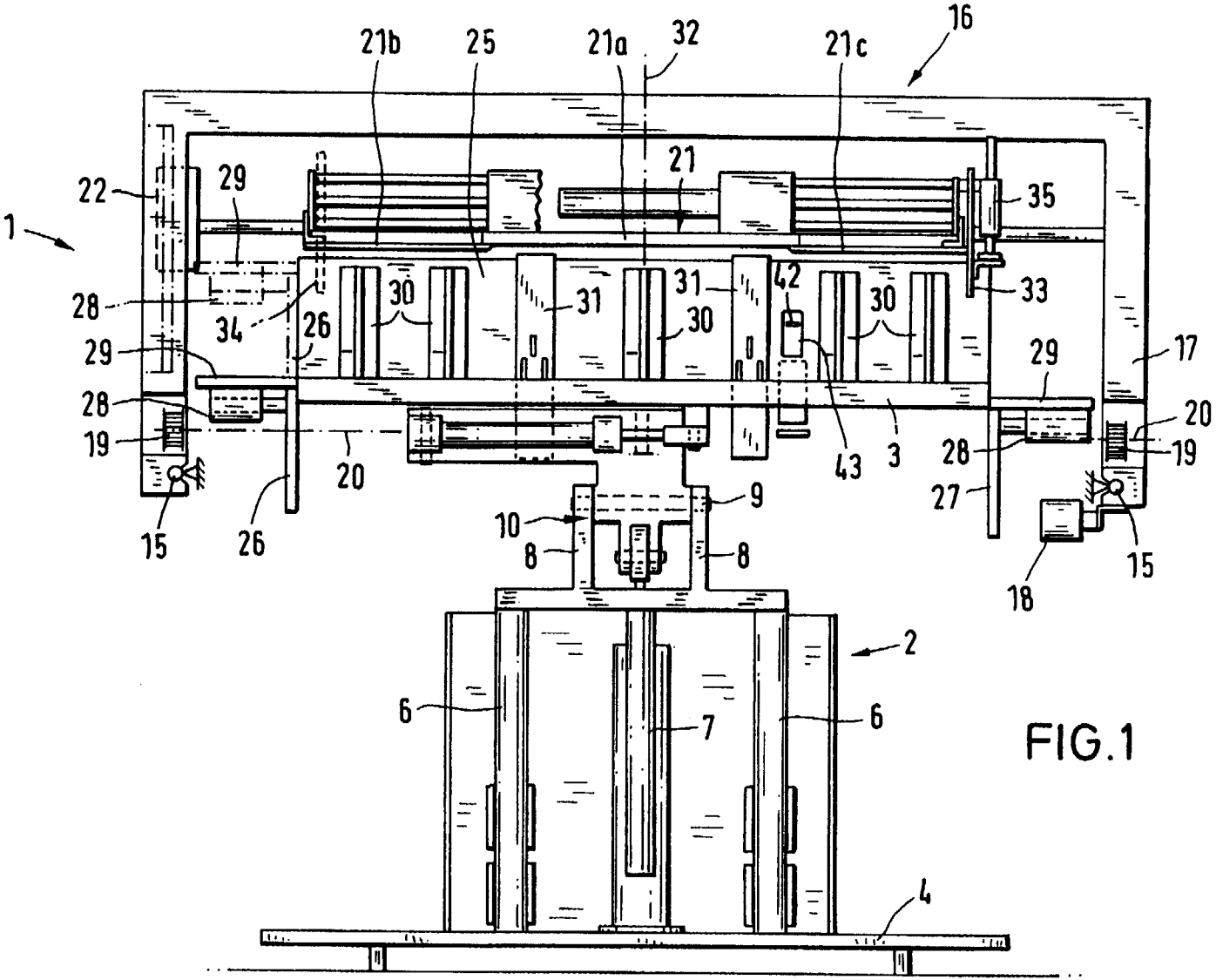
FIG. 1 is a front view of the jogger in accordance with the invention.
Figure 2:
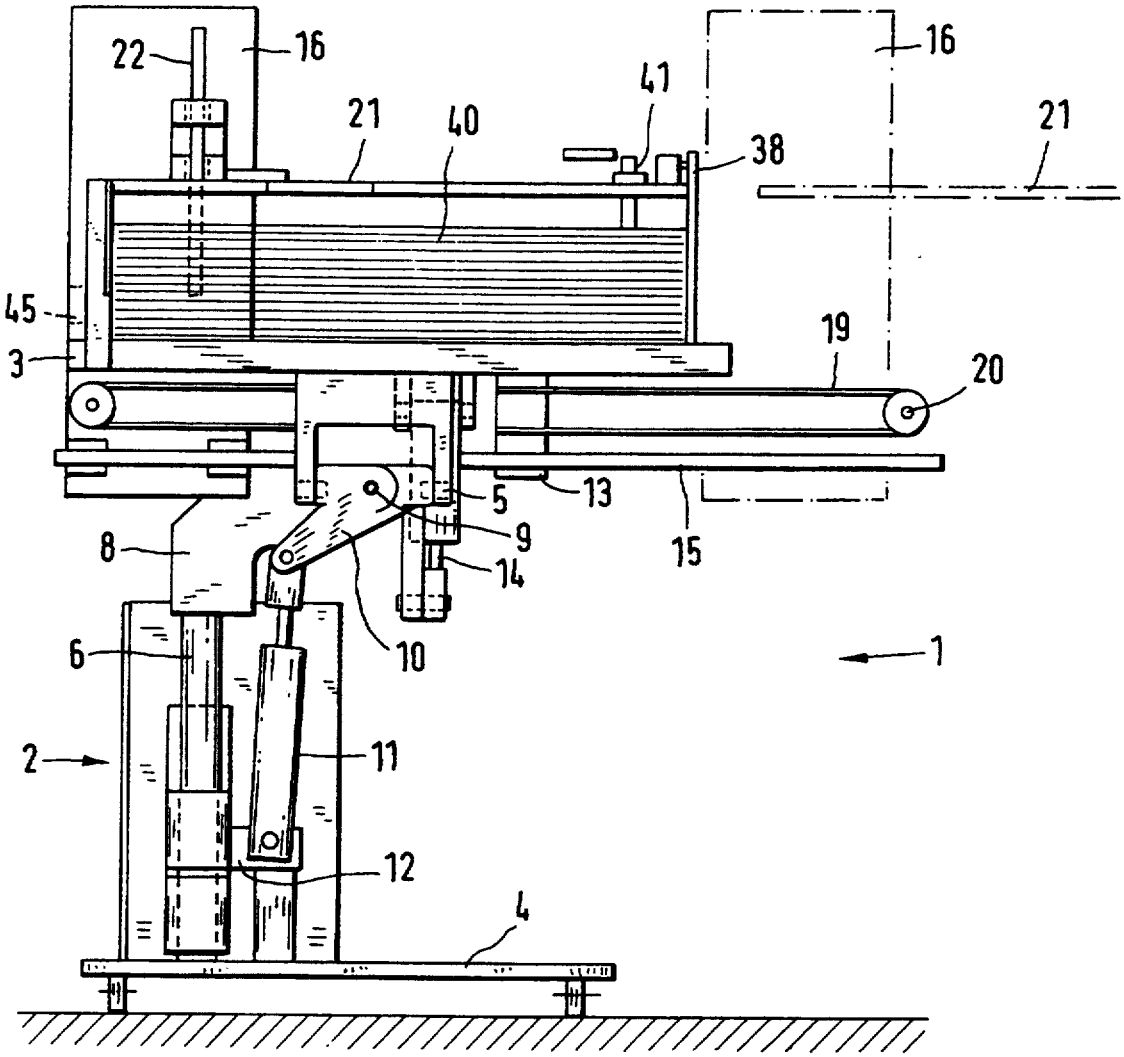
FIG. 2 is a side view of the jogger.

FIGS. 1 and 2 illustrate a jogger 1. A stack-supporting surface 3 rests on a stand 2 on a base 4. Stand 2 is bifurcated and has a post 6 on each side and a piston-and-cylinder mechanism 7 in the middle. A flanged section 8 of stand 2 accommodates a bearing 10 that pivots around an axis 9. Another piston-and-cylinder mechanism 11 positioned remote from axis 9 on an arm 12 on post 6 engages bearing 10.

A known vibrator 13 vibrates stack-supporting surface 3 by a known procedure. Stack-supporting surface 3 pivots on an axis 5 perpendicular to axis 9 subject to another piston-and-cylinder mechanism 14. One end of piston-and-cylinder mechanism 14 is connected to the bottom of stack-supporting surface 3 and away from axis 5 and the other end to bearing 10. Piston-and-cylinder mechanism 7 is responsible for raising and lowering stack-supporting surface 3, and piston-and-cylinder mechanism 11 for tilting it upright, 90°, around axis 9. Piston-and-cylinder mechanism 14, finally, is responsible for pivoting the stack-supporting surface at least 20° to either side around axis 5, as represented with respect to one side in FIG. 8. The surface can of course be tilted around axes 5 and 9 at the same time.

Figure 3:
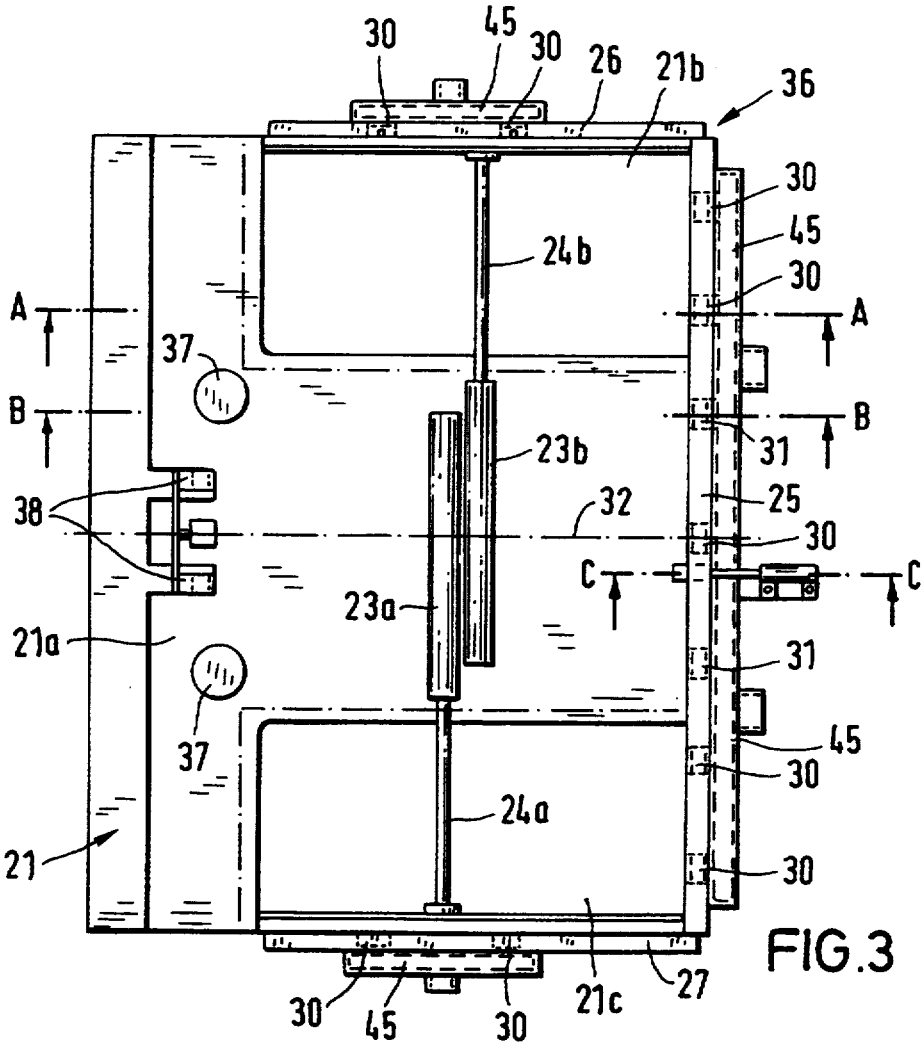
FIG. 3 is a top view of the jogger showing essentially the top-covering plate and the stack-supporting surface along with the mechanisms that operate in conjunction with them.

Secured on each side to the bottom of stack-supporting surface 3 are two tracks 15. A gantry 16 extends across stack-supporting surface 3 and travels back and forth along tracks 15. Gantry 16 is controlled by a cylinder 18. Cylinder 18 lacks a piston and is attached to one upright 17 of gantry 16. A cogged belt 19 is positioned on each side of stack-supporting surface 3. Cogged belts 19 are connected by a gang shaft 20 and ensure that gantry 16 will travel square. A top-covering plate 21 travels back and forth parallel to stack-supporting surface 3 in gantry 16. Top-covering plate 21 is controlled by a motor through a transmission 22. Transmission 22 includes a friction clutch. As will be evident from FIG. 3, top-covering plate 21 has the same rectangular shape and essentially the same dimensions as stack-supporting surface 3. Since top-covering plate 21 is in three parts, it can be adjusted to cover areas of different size. Top-covering plate 21 comprises a T-shaped base 21*a* secured in gantry 16 and two components 21*b* and 21*c* that slide together and apart in base 21*a*. When apart, components 21*b* and 21*c* occupy the residual area of the rectangular top-covering plate 21. FIG. 3 illustrates top-covering plate 21 with components 21*b* and 21*c* apart and accordingly covering the largest area possible. Top covering-plate base 21*a* and components 21*b* and 21*c* are dimensioned to ensure that the gap between base 21*a* and component 21*b* and the gap between base 21*a* and component 21*c* will be as narrow as possible. Two pneumatic cylinders 23*a* and 23*b* are secured to the upper system of top covering-plate base 21*a*. Cylinders 23*a* and 23*b* operate in conjunction with piston rods 24*a* and 24*b* secured to top covering-plate components 21*b* and 21*c*.

The jogger 1 in accordance with the present invention is intended for jogging a stack 40 of material in two directions. It accordingly includes three lateral baffles for the stack to impact against on three corresponding sides of stack-supporting surface 3. First lateral baffle 25 is secured stationary to one side of stack-supporting surface 3, second lateral baffle 26 is associated with one end of stack-supporting surface 3, and third lateral baffle 27 is associated with the other end of the surface. Second lateral baffle 26 and third lateral baffle 27 are parallel and can be raised and lowered in relation to stack-supporting surface 3 by an unillustrated mechanism. A cheek 29 for securing stack 40 travels perpendicular to each lateral baffle 26 and 27 subject to a piston-and-cylinder mechanism 28.

While it is being jogged, the stack is winded by blowers integrated into lateral baffles 25, 26, and 27. The blowers comprise stabilizing nozzles 30 or fanning nozzles 31 or both. Since the direction the wind travels in is mainly dictated by the longer first lateral baffle 25, first lateral baffle 25 should have not only the stationary stabilizing nozzles 30 but also fanning nozzles 31, which travel perpendicular to the stack-supporting surface 3. Stabilizing nozzles 30 in particular should be accommodated in the ends of first lateral baffle 25 that face lateral baffles 26 and 27. It will be sufficient for the lateral baffles 26 and 27 associated with the sides of stack-supporting surface 3 to have only stationary stabilizing nozzles 30 integrated into them. Either the area of the wind outlets in each stabilizing nozzle 30 is adjustable, or the top and bottom of each outlet can be blocked off in accordance with how high stack 40 is, or the whole outlet can be blocked off. These features are not illustrated in the drawing. Fanning nozzles 31 can be provided with slides perforated to a limited extent. This feature is also no illustrated.

The illustrated jogger can have two side-covering plates 33 and 34 associated with and separable from top covering-plate components 21*b* and 21*c*. The figures illustrate only the side-covering plate 33 associated with component 21*c* and employed for jogging in the right-hand corner of the jogger. Another side-covering plate 34, indicated raised by the broken lines, would be employed instead for jogging in the left-hand corner. Side-covering plate 34 would be positioned on top covering-plate component 21*b* symmetrical with respect to a plane 32 of symmetry perpendicular to stack-supporting surface 3. Each side-covering plate 33 and 34 is accordingly mounted on the top covering-plate component 21*b* or 21*c* facing the corner between first lateral baffle 25 and second lateral baffle 26 or between first lateral baffle 25 and third lateral baffle 27 the stack 40 is being jogged in. As will be evident from FIG. 1, side-covering plate 33 can be positioned perpendicular to first lateral baffle 25 and displaced perpendicular to the plane of top covering-plate component 21*c* by an electrically operated mechanism 35 accommodated in that component. Side-covering plate 33 is accordingly associated with third lateral baffle 27 and side-covering plate 34 with second lateral baffle 26. Another mechanism associated with top covering-plate component 21*b* positions second lateral baffle 26.

How the jogger hereintofore basically specified operates will now be specified.

Jogger 1 is assumed to be initially in the state illustrated in FIGS. 1 and 2 and with gantry 16 in the position illustrated in FIG. 2. A stack 40 to be jogged is laid off onto the horizontal stack-supporting surface 3. If the stack is to be jogged in the left-hand corner 36 of surface 3, side-covering plate 34 will be removed and only side-covering plate 33 will in accordance with the invention be employed. Once stack 40 is resting on stack-supporting surface 3, top-covering plate 21 is advanced over them and the second lateral baffle 26, which is associated with left-hand corner 36, is entirely extracted into the position represented by the dot-and-dash lines. With first lateral baffle 25 stationary and second lateral baffle 26 disengaged, stack-supporting surface 3 can be tilted to one side into the position illustrated in FIG. 8 (toward both first lateral baffle 25 and second lateral baffle 26). Stack 40, which consists of various tiers, will accordingly be oriented toward both baffles when the jogger is turned on. The operation of the jogger in accordance with the invention is up to this point similar to that of a conventional jogger.

In accordance with the present invention, however, transmission 22 will now lower top-covering plate 21 toward stack 40 with stack-supporting surface 3 either slightly tilted or in the initial position illustrated in FIGS. 1 and 2. A probe 41 accommodated in top covering-plate base 21*a* and illustrated only in FIG. 2 will now locate the top of stack 40 and will ensure that transmission 22 positions top-covering plate 21 at a prescribed distance away from the top of the stack.

Figure 8:
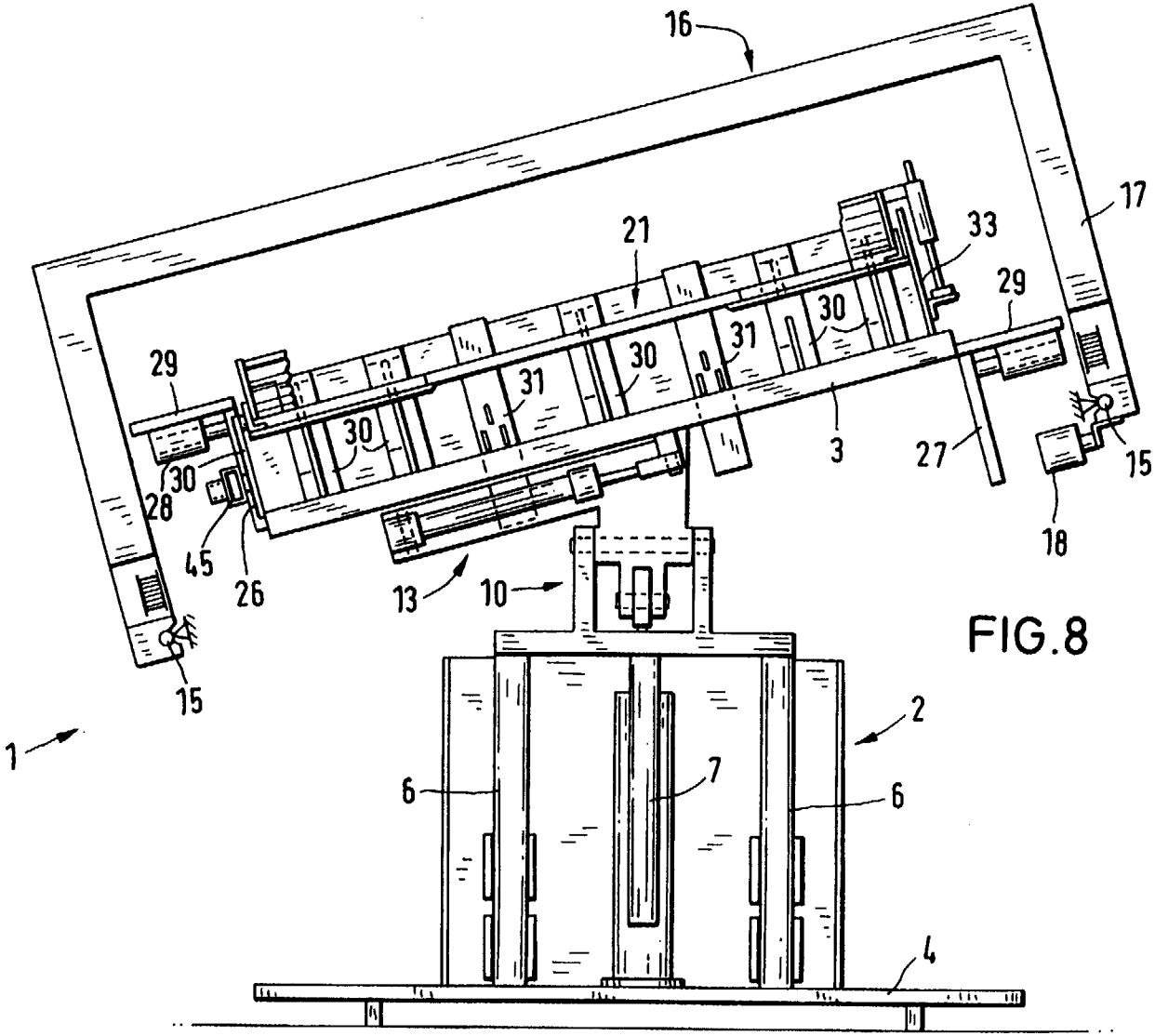
FIG. 8 is a front view like that in FIG. 1 with the stack-supporting surface tilted.

Stack 40 is specifically composed of sheets of paper, cardboard, plastic, etc. Side-covering plate 33 operates on the side of stack 40 that faces second lateral baffle 26. Plate 33 is lowered by mechanism 35 onto the surface of stack-supporting surface 3 as illustrated in FIG. 8. Top covering-plate component 21*c* has already been engaged by its associated pneumatic cylinder 23*a* to adjust the length of top-covering plate 21 in the vicinity of its components 21*b* and 21*c* to that of the stack. Top covering-plate component 21*c* is advanced, that is, until side-covering plate 33 is adjacent to the associated side of the stack. The stack is accordingly completely enclosed, closed off on five sides, that is, as far as the side of stand 2 facing first lateral baffle 25. The resulting wind chamber can automatically be adjusted to the size of the sheets and the height of the stack in order to minimize loss of wind.

The jogging mechanism is now actuated along with the stabilizing nozzles 30 and fanning nozzles 31 in lateral baffles 25 and 26 (but not the nozzles in the unemployed third lateral baffle 27). Stack-supporting surface 3 is tilted to the desired angel. The tiers in stack 40 will float on the intervening wind between stack-supporting surface 3 and top-covering plate 21. Stabilizing nozzles 30 wind the entire width of stack 40 and prevent it from S-curving. Fanning nozzles 31 briefly lift the just winded section of the stack from the associated lateral baffles 25 and 26. It should be attempted to ensure that a narrow gap is initially left as side-covering plate 33 descends onto the surface of stack-supporting surface 3 and that the plate will be slowly and gently advanced past the stack. Top-covering plate 21 can be adjusted to smaller sheets in this way by engaging pneumatic cylinder 23a. The purpose of side-covering plate 33, and of side-covering plate 34 as well of course when it is employed, is to prevent wind from escaping at the side and to help straighten the stack. Top covering-plate base 21*a* can also accommodate other, unillustrated, nozzles to generate a cushion of wind between stack 40 and top-covering plate 21 while the stack is being jogged. FIG. 3 also illustrates two holddowns 37 accommodated in base 21*a* on the side of top-covering plate 21 facing away from first lateral baffle 25. Holddowns 37 are intended to hold stack 40 down tight on stack-supporting surface 3. The gap of approximately 20 to 40 mm between top-covering plate 21 and stack 40 promotes the separation and floating of the separate tiers. The stack 40 is secured with a narrow and variable gap between lateral baffles 25 and 26. Separately projecting tiers must be prevented from skewing. The jogging can be optimized by, especially two, variable auxiliary jogging baffles 38 near plane 32 of symmetry and facing first lateral baffle 25 on the side of top covering-plate base 21*a* facing away from that baffle. Auxiliary jogging baffles 38 act on the side of the stack facing away from first lateral baffle 25. Auxiliary jogging baffles 38 can also be adjusted to the size of the sheets and the height of the stack. After brief winding and jogging, auxiliary jogging baffles 38 are lowered approximately 20 mm off the stack and slowly and gently advanced past the stack to the prescribed sheet size by an auxiliary transmission. Any projecting tiers will be forced into the winded stack.

Figure 7:
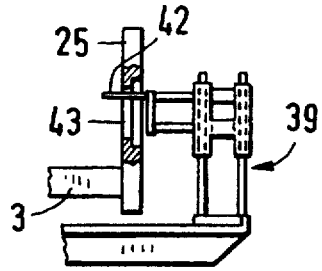
FIG. 7 is a section similar to that in FIG. 6 with a holder reaching through the breach.

Once one tier of the stack has been jogged and stack-supporting surface 3 has been returned to the horizontal, another tier can be jogged on top of the first. In this event the holder 42 illustrated in FIG. 7 and actuated by a pneumatic cylinder 39 will reach through a breach 43 in first lateral baffle 25 and descend on the lower tier to clamp it against stack-supporting surface 3 while the second tier is being added. Breach 43 can be provided with a seal 44 to prevent or extensively inhibit wind from leaking through it when the holder is disengaged, during winding and jogging, that is.

Figure 4:
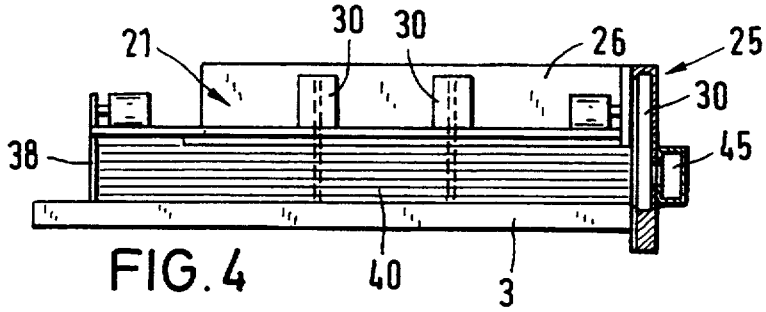
FIG. 4 is a section along the line A—A in FIG. 3.
Figure 6:
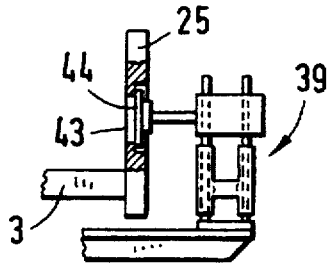
FIG. 6 is a section along the line C—C in FIG. 3, the breach in the first lateral baffle being sealed.
Figure 5:
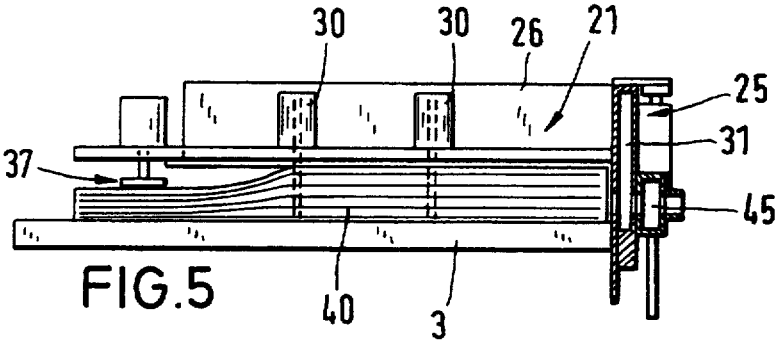
FIG. 5 is a section along the line B—B in FIG. 3.

As will be particularly evident from FIGS. 3 through 5, the wind is supplied to the stabilizing nozzles 30 and fanning nozzles 31 associated with lateral baffles 25, 26, and 27 through a distributor 45. The invention need accordingly not employ only ordinary air for wind. If the sheets being jogged are of a material that readily accepts an electric charge, the wind can be ionized air.

Subsequent to jogging, stack-supporting surface 3 is returned to the position illustrated in FIGS. 1 and 2, with gantry 16 in the position represented by the dot-and-dash line in FIG. 2. The stack-securing cheek 29 associated with second lateral baffle 26 is advanced over the facing end of stack 40 and the stack will be clamped at that site as second lateral baffle 26 descends. An unillustrated stroker can then express the wind from the stack. Such a stroker can be a roller accommodated in the gantry paralleling second lateral baffle 26 and rolling over the top of the stack. The jogged stack can then be transferred to a take-off surface or to another location for further processing, in a paper cutter for example.

I claim:

1. A jogger for straightening material in tiers, comprising: at least two parallel lateral baffles associated with adjacent sides of a stack-supporting surface that can vibrate, said stack-supporting surface being in a plane; a gantry traveling back and forth in said plane, said stack-supporting surface being tiltable out of a horizontal plane toward said two lateral baffles; a top-covering plate mounted in said gantry and paralleling said stack-supporting surface, a stack being located between said top-covering plate and said stack-supporting surface; means in said gantry and lowering said top-covering plate onto said stack-supporting surface and raising said top-covering plate off said stack-supporting surface; blowers for forcing wind between said tiers and located in at least one of said lateral baffles; at least one side-covering plate for closing off a space between said stack-supporting surface and said top-covering plate, means for positioning said side-covering plate at a right angle to a first one of said two lateral baffles and for moving said side-covering plate toward and away from the second one of said lateral baffles.

2. A jogger as defined in claim 1, wherein said top-covering plate has a plurality of parts sliding together and apart in a specific direction.

3. A jogger as defined in claim 1, including a third lateral baffle for said stack positioned together with said second lateral baffle at each end of, and at a right angle to, said first lateral baffle, said second and third baffles being movable parallel to each other and perpendicular to said stack-supporting surface.

4. A jogger as defined in claim 3, wherein said second lateral baffle and said third lateral baffle have, adjacent whichever baffle end is up, a stack-securing cheek extending perpendicular to said second baffle and said third baffle and traveling back and forth in a plane.

5. A jogger as defined in claim 1, wherein said blowers for forcing wind between the tiers are integrated into at least said second lateral baffle.

6. A jogger as defined in claim 1, wherein said first lateral baffle cooperates with a longer side of said stack-supporting surface, said stack-supporting surface having a rectangular shape, at least said second lateral baffle cooperating with a shorter side of said stack-supporting surface.

7. A jogger as defined in claim 1, wherein said blowers are integrated into said first lateral baffle and have stationary stabilizing nozzles at the ends of said first lateral baffle; and moving fanning nozzles perpendicular to said stack-supporting surface.

8. A jogger as defined in claim 7, wherein an area of an outlet with a top and bottom of each stabilizing nozzle is adjustable, said top and bottom of said outlet being adjustable in accordance with the height of said stack.

9. A jogger as defined in claim 7, wherein said fanning nozzles have a slide with outlets of limited height.

10. A jogger as defined in claim 1, wherein said blowers in said second lateral baffle and in a third lateral baffle have stationary stabilizing nozzles.

11. A jogger as defined in claim 1, including a mechanized holder reaching through a breach in said first lateral baffle and clamping down on one tier of the stack, said breach having a seal engaging when said holder is disengaged.

12. A logger as defined in claim 1, wherein said top-covering plate has a rectangular and tripartite cross-section and comprises a T-shaped base mounted in said gantry and two components sliding together and apart into a remainder of the rectangular cross-section.

13. A jogger as defined in claim 12, including two pneumatic cylinders mounted on the top of a base with piston rods engaging said components for actuating said components.

14. A jogger as defined in claim 1, including another side-covering plate and a third lateral baffle; said at least one side-covering plate being adjacent said second lateral baffle and said another side-covering plate, said another side-covering plate being similar in structure and action and being parallel to said first-mentioned side-covering plate adjacent said third lateral baffle.

15. A jogger as defined in claim 14, wherein said first-mentioned side-covering plate is located in one of said components and said another side-covering plate is located in the other one of said components.

16. A jogger as defined in claim 1, including means for displacing said at least one side-covering plate perpendicular to a top of said stack-supporting surface.

17. A jogger as defined in claim 1, wherein a side of said top-covering plate faces away from said first lateral baffle and has a plurality of holddowns for holding down said stack.

18. A jogger as defined in claim 17, wherein two of said holddowns are located in a base of said top covering-plate.

19. A jogger as defined in claim 1, wherein said top-covering plate has a base, said top-covering plate and said base having additional blowers for generating a cushion of wind between said top-covering plate and a top of said stack.

20. A jogger as defined in claim 1, wherein said top-covering plate has a base, said top-covering plate and said base having auxiliary jogging baffles that can be aimed toward said first lateral baffle in an area of said stack-supporting surface facing away from said first lateral baffle.

21. A jogger as defined in claim 1, including a further side-covering plate with at least one wind outlet positioned parallel to and away from said first lateral baffle and traveling back and forth laterally and perpendicularly thereto.

* * * * *